US005427416A

United States Patent [19]

Birch

[11] Patent Number: 5,427,416

[45] Date of Patent: Jun. 27, 1995

[54] BUSINESS FORM

[75] Inventor: Neil W. Birch, Sandton, South Africa

[73] Assignee: Lithosaver Systems Limited, Johannesburg, South Africa

[21] Appl. No.: 131,456

[22] Filed: Oct. 4, 1993

[30] Foreign Application Priority Data

Dec. 22, 1992 [ZA] South Africa ..... 92/9961
Mar. 4, 1993 [ZA] South Africa ..... 93/1549
Sep. 6, 1993 [ZA] South Africa ..... 93/6560

[51] Int. Cl.[6] ..... B42D 15/00

[52] U.S. Cl. ..... 283/109; 283/75; 283/94; 283/105; 283/108; 156/253; 156/248; 462/6

[58] Field of Search ..... 283/75, 101, 105, 107, 283/109, 108, 6194, 62, 904, 116; 462/64, 65, 6; 428/131, 137, 40, 41, 42, 43; 229/303; 281/38; 156/252, 253, 247, 248

[56] References Cited

U.S. PATENT DOCUMENTS

| | | | |
|---|---|---|---|
| 1,265,159 | 5/1918 | Alexander | 283/116 |
| 2,616,612 | 11/1952 | Guttman . | |
| 2,708,068 | 5/1955 | Guttman . | |
| 4,379,573 | 4/1983 | Lomeli et al. | 283/81 X |
| 4,505,770 | 3/1985 | Larimore | 283/81 X |
| 4,635,965 | 1/1987 | Vogt | 283/112 |
| 4,890,862 | 1/1990 | Bucholz | 283/81 X |
| 4,910,058 | 3/1990 | Jameson | 283/101 X |
| 4,982,894 | 1/1991 | Schmidt | 283/75 X |
| 4,986,868 | 1/1991 | Schmidt . | |
| 5,131,686 | 7/1992 | Carlson | 283/107 X |
| 5,149,587 | 9/1992 | Hill et al. | 283/81 X |
| 5,172,938 | 12/1992 | Schmidt | 283/109 |

FOREIGN PATENT DOCUMENTS

| | | | |
|---|---|---|---|
| 0222424 | 10/1986 | European Pat. Off. . | |
| 8001262 | 2/1980 | Netherlands . | |
| 1569850 | 6/1980 | United Kingdom . | |
| 2084077 | 4/1982 | United Kingdom | 283/81 |
| 2235412 | 7/1989 | United Kingdom . | |
| 2221188 | 1/1990 | United Kingdom | 283/81 |
| 2254045 | 9/1992 | United Kingdom . | |
| 2257657 | 1/1993 | United Kingdom . | |
| WO92/05036 | 4/1992 | WIPO . | |

OTHER PUBLICATIONS

Abstract of German Gebrauchsmuster 8435729 dated Mar. 21, 1985, one page.

*Primary Examiner*—Frances Han
*Attorney, Agent, or Firm*—Darby & Darby

[57] ABSTRACT

A business form 10 includes a planar carrier 12 having a card 14 demarcated therein and a window 18 defined in the carrier 12 adjacent the card 14. A planar element 20 of a synthetic plastics material is laminated to the carrier 12 in register with the card 14 and the window 18 so that a part 20.1 of the element 20 is arranged within the window 18. A coating of adhesive material is carried by at least that part 20.1 of the element 20 in the window 18 so that, upon removal of the card 14 and that part 20.1 of the element 20 in the window 18, said part 20.1 of the element 20 can be folded over onto the card 14 and adhesively secured to the card 14 to form an arrangement where both surfaces of the card 14 are covered by the plastics material.

36 Claims, 6 Drawing Sheets

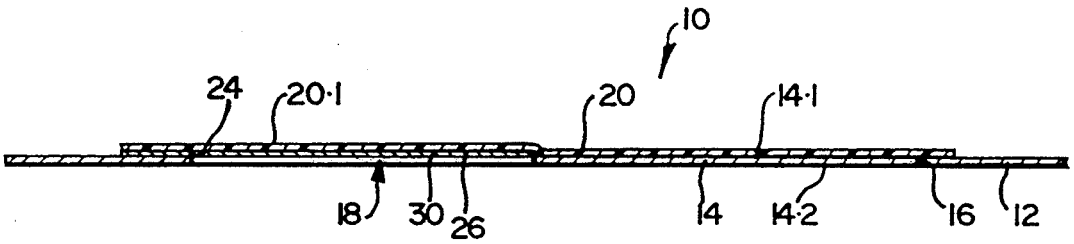
FIG 3A
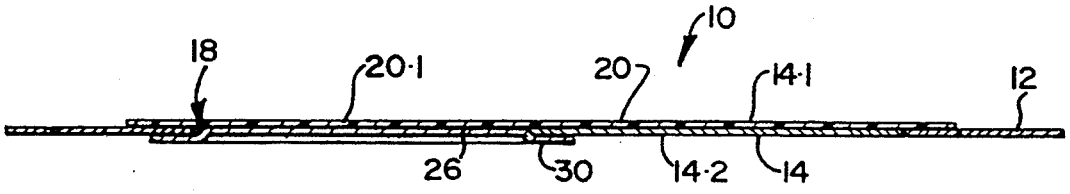
FIG 3
FIG 3B

BUSINESS FORM

FIELD OF THE INVENTION

This invention relates to a business form. More particularly, the invention relates to a business form and to a method of manufacturing such form.

SUMMARY OF THE INVENTION

According to a first aspect of the invention, there is provided a business form which includes

- a planar carrier including a card and a window defined in the carrier adjacent the card;
- a planar element of a synthetic plastics material laminated to the carrier in register with the card and the window so that a part of the element is arranged within the window; and
- a coating of adhesive material carried by at least that part of the element in the window so that, upon removal of the card and that part of the element in the window, said part of the element can be folded over onto the card and adhesively secured to the card to form an arrangement where both surfaces of the card are covered by the plastics material.

It will be appreciated that the carrier may have more than one card with its associated window. Then, each card and window will have an element of synthetic plastics material associated therewith.

The carrier may be in the form of a sheet of cellulosic material, such as paper, cardboard, or the like, on which predetermined information is carried.

In a first embodiment of the invention, the card may be demarcated in the carrier. The card may be demarcated in the carrier by a zone of weakness circumscribing the card.

The card may be substantially rectangular in outline and may be bounded on at least three sides by said zone of weakness with the window being arranged adjacent a fourth side of the card such that the window and the card have a common side. The card and the window may be substantially the same size.

The zone of weakness may be in the form of perforations which extend through the carrier and the element. The said part of the element in the window of the carrier may be separable from the remainder of the element via a further zone of weakness. Said further zone of weakness may also be in the form of perforations.

The adhesive material may be a pressure sensitive adhesive.

The coating of adhesive on said part of the element in the window may be covered by a removable backing sheet.

The carrier may be substantially rectangular and is divided into three substantially equal parts, the parts being demarcated by fold lines. The card and the window may be arranged in a central part of the carrier with the element being laminated to said central part, the carrier being foldable about said fold lines in a predetermined configuration for mailing purposes.

As a development of this embodiment of the invention, a border strip may be demarcated about the periphery of the card, intermediate the card and the carrier. The border strip may be formed by butt cutting a border of perforations in the carrier to demarcate the border strip from the card. Then, upon separation of the element with the card and border strip thereon, the strip may be removed and, when the part of the element which had been in the window is folded over onto the card, a border is defined around the card by the element thereby improving moisture-proofing of the card. It will be appreciated that, in this case, said border strip will be constituted by a backing sheet which, after removal, reveals a part of the element which also has an adhesive coating thereon.

In a second embodiment of the invention, the card may be a separate member which is secured on the element. Then, the card may be of a different grade of paper from the paper of the carrier. Thus, the card may be of a higher grade of paper than that of the carrier.

A double window may be defined in the carrier with the card being mounted on a part of the element in one of the windows, and at least that part of the element in the other of the windows having the coating of adhesive. By "double window" is meant that the window has an area twice the size of the window of the first embodiment of the invention.

The card may be smaller than the window in which it is arranged to be surrounded by a border region of synthetic plastics material defined by the planar element. The border region defined by the element may also carry a coating of adhesive material.

Once again, the adhesive material may be a pressure sensitive adhesive and the coating of adhesive material may be covered by a removable backing sheet.

According to a further aspect of the invention, there is provided a method of manufacturing a business form as described above with reference to the first embodiment of the invention, which includes the steps of

- providing a planar carrier;
- forming a window in the carrier;
- laminating a planar element of a synthetic plastics material to one surface of the carrier in register with the window and to a region adjacent the window so that a part of the element is arranged within the window and at least said part has a coating of adhesive material; and
- demarcating a card in the carrier in said region adjacent the window.

The method may include providing the carrier in a continuous web, each carrier being demarcated in the web.

The method may then include demarcating the card adjacent the window by forming a zone of weakness, in the shape of the card, in the carrier adjacent the window. The zone of weakness may be formed by making perforations in the carrier and in that part of the element adjacent the window. The perforations may be made by die-cutting.

The method may further include forming a further zone of weakness in that part of the element in the window, said zone of weakness circumscribing an area of the element which is substantially the same area as that of the card. Said further zone of weakness may also be constituted by perforations, the perforations being formed by die-cutting.

In one embodiment, the method may include providing the planar element with one side thereof coated with an adhesive material, the adhesive material being covered by a backing sheet.

The window and the card may be substantially rectangular in outline with the card being arranged against one side of the window to have a common side with the window and the method may then include applying an adhesive about remaining sides of the window, other than the common side, on said one surface of the carrier.

Then, the method may include removing a part of the backing sheet from the element to expose the coating of adhesive material on a further part of the planar element, adjacent said part of the element which is in register with the window in the carrier, and laminating the planar element to said one surface of the carrier by adhesively securing said further part of the planar element to the carrier adjacent the window and, by means of the adhesive around said remaining sides of the window, attaching a remaining part of the backing sheet of the planar element, and, hence, the planar element, to said one surface of the carrier.

The method may then include forming a cut in the backing sheet in a direction of travel through a manufacturing machine to remove said part of the backing sheet and aligning said cut with the common side between the window and the card.

In another embodiment, after the window has been formed in the carrier, and before the card is demarcated, an adhesive may be applied around the window and in the region adjacent the window on said one surface of the carrier and the planar element may then be adhesively secured to said surface of the carrier.

The method may then include, on an opposed surface of the carrier, applying a coating of adhesive at least on that part of the element in the window and covering the coating with a removable backing sheet.

According to yet a further aspect of the invention there is provided a method of manufacturing a business form as described above with reference to the second embodiment of the invention, which includes the steps of providing a planar carrier;

forming a double window in the carrier;

laminating a planar element of a synthetic plastics material to the carrier in register with the double window; and mounting a card on the element in one of the windows.

The method may include coating at least that part of the element in the other of the windows with an adhesive material. The method may then include covering the coating with a removable backing sheet.

BRIEF DESCRIPTION OF THE DRAWINGS

The invention is now described by way of example with reference to the accompanying diagrammatic drawings.

In the drawings,

FIGS. 3*a* and 3*b* show sectional end views of two different versions of the business form of the first embodiment of the invention taken along line III—III in FIG. 1 of the drawings;

DETAILED DESCRIPTION OF THE DRAWINGS

Figure 1:
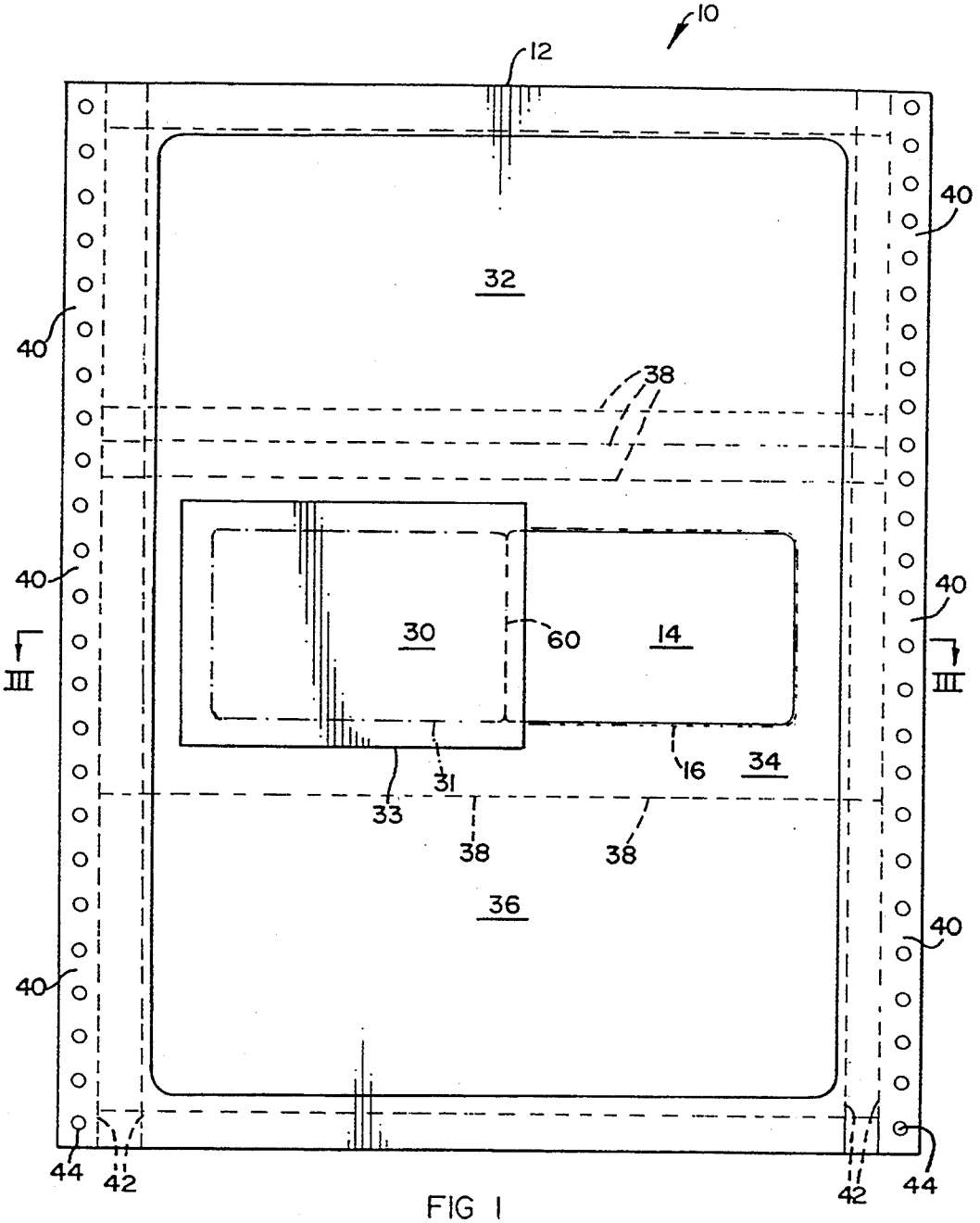
FIG. 1 shows a front view of a business form, in accordance with a first embodiment of the invention.
Figure 2:
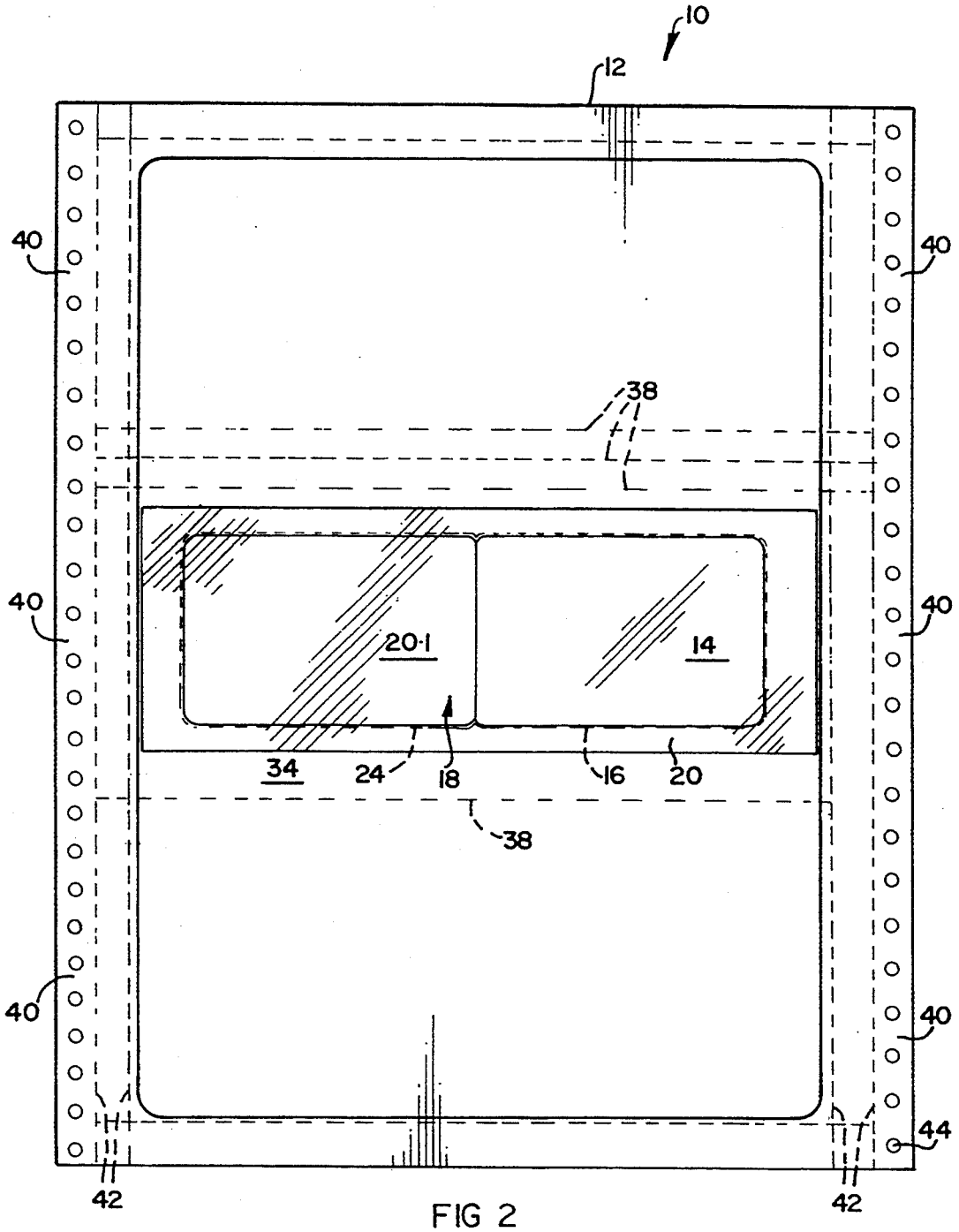
FIG. 2 shows a rear view of the business form of FIG. 1.

Referring firstly to FIGS. 1 to 3 of the drawings, a business form, in accordance with a first embodiment of the invention, is illustrated and is designated generally by the reference numeral 10.

The form 10 comprises a carrier 12 in which a rectangular card 14 is demarcated. The card 14 is demarcated on the carrier 12 via a zone or line of weakness in the form of perforations 16 which define three sides of the card 14. The card 14 carries predetermined information thereon such as, for example, details of a club membership, or the like and thus, the form 10 may serve as an application form for such club membership.

A window 18 (FIGS. 2 and 3) is defined in the carrier 12 adjacent a fourth side of the card 14, said fourth side constituting a common side with the window 18.

A planar element in the form of a strip 20 of synthetic plastics material is laminated to the carrier 12 in register with the card 14 and the window 18. The strip 20 is of a transparent plastics material and, when laminated to the carrier 12, forms a protective covering for a first surface 14.1 of the card 14.

That part 20.1 of the strip 20 in the window 18 is demarcated from the rest of the strip 20 via a further zone of weakness in the form of perforations 24. The area of the window 18 containing the part 20.1 is slightly greater than the area of the card 14. The perforations 24 are formed slightly inwardly of the periphery of the window 18 so that adhesive runs to the edge of the part 20.1 after removal from the remainder of the strip 20. The perforations 24 bordering the part 20.1 define an area which is substantially the same as that of the card 14.

A surface 26 of the strip 20 in the window 18 carries a layer or coating of adhesive material. The surface 26 is covered by a backing sheet or silicone release 30.

The form 10 is a one-piece form and is divided into three substantially equal parts 32, 34 and 36 by perforations 38. The perforations 38 also serve as fold lines along which the parts 32, 34 and 36 are folded relative to one another. The card 14, the window 18 and the strip 20 are arranged in the central part 34 of the carrier 12. Further, end flaps 40 are defined at the ends of each part 32, 34, 36 by perforations 42 extending longitudinally adjacent either side of the carrier 12. It will be appreciated that the perforations 38 and 42 are also formed during the die-cutting of the carrier 12. The end flaps 40 have openings 44 arranged thereon for transporting the form 10, during its manufacture, through a manufacturing machine.

Figure 5:
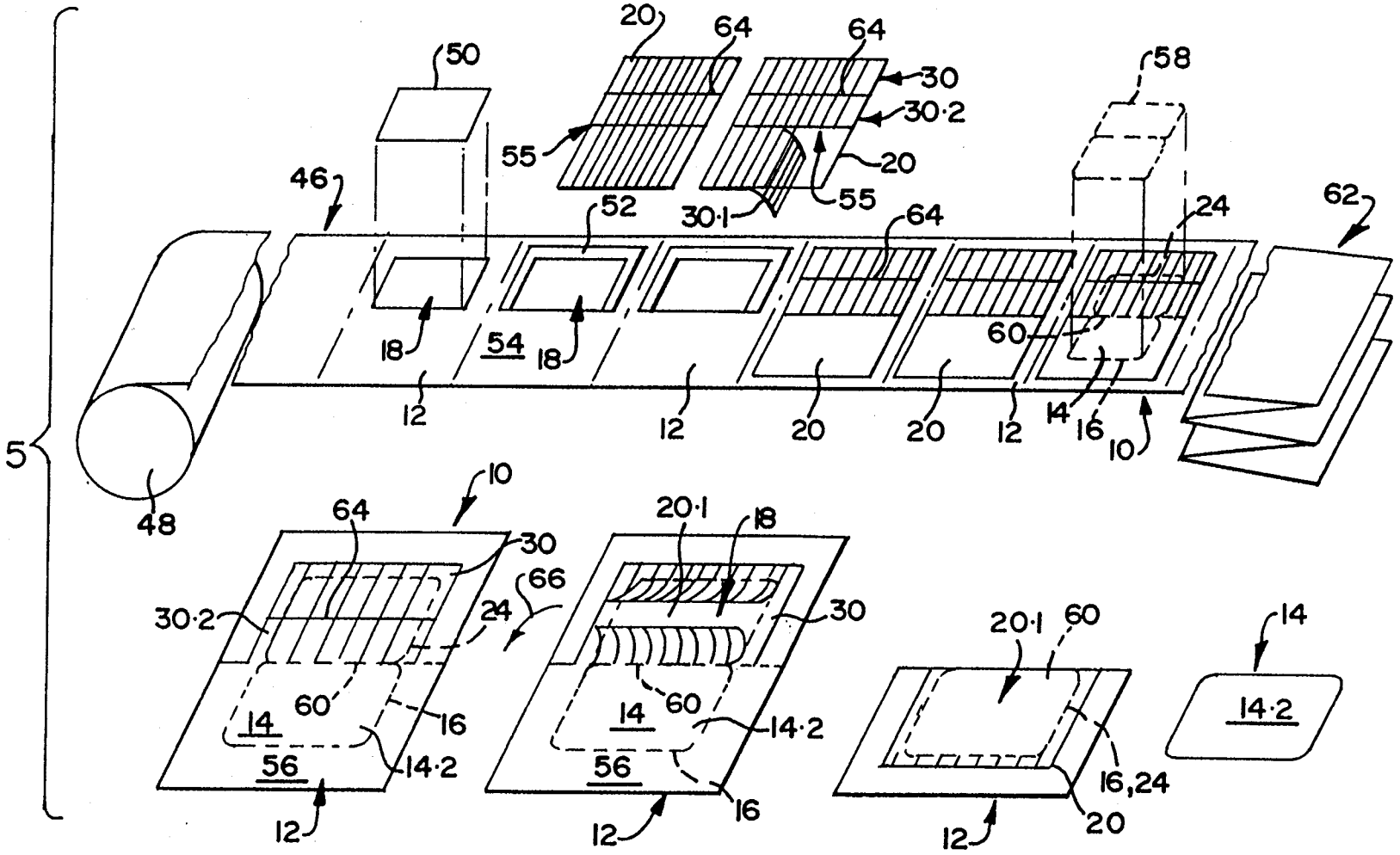
FIG. 5 shows various stages of one embodiment of the manufacture and use of the business form of FIGS. 1, 2 and 3*a*.

Referring now to FIG. 5 of the drawings, a 15 schematic representation of the manufacture and use of the business form of FIGS. 1, 2 and 3*a* is illustrated.

The carriers 12 are demarcated on a web 46 of material which is fed off a roll 48. A plurality of the carriers 12 are demarcated side by side on the web 46. In each carrier 12, the window 18 is cut by a cutting die 50. In the next stage of the operation, adhesive 52 is applied on a surface 54 of the carrier 12 about three sides of the window 18. The plastics strip 20 which has been precoated with adhesive and covered with the backing sheet 30 (which in this embodiment covers the whole strip 20) is introduced on to the main web 46. A cut 55 is formed in the backing sheet 30, the cut 55 extending in the backing sheet 30 in the direction of travel of the web 46.

A part 30.1 of the backing sheet 30 covering that part of the strip 30 which, in use, will cover the surface 14.1 of the card 14, is removed from the strip 20 along the cut 55. A part 30.2 of the backing sheet 30 which remains on the strip 20 is secured to the carrier 12 via the adhesive 52 with the exposed, adhesively coated part of the strip 20 being secured to the surface 54 of the carrier 12 adjacent the window 18.

A cutting die 58, which is an intermittent die then creates the perforations 16 and 24. The cutting die 58 also creates a centre perforation 60. In the manufacture of the business form 10, care is taken to align said centre perforation 60 with the inner edge of the remaining part 30.2 of the backing sheet 30. It is to be noted that, in FIG. 1 the backing sheet, in the case of this embodiment of the manufacture of the form 10, is shown by the dot-dash line 31 while in the case of the embodiment of the manufacture of the form 10 referred to with reference to FIG. 6 below, the backing sheet 30 is shown by the solid line 33.

At this point, the business forms 10 are folded over into a concertina fashion, as indicated schematically at 62, and are ready for use.

For use, the business form 10 is inverted to expose surface 56 of the carrier 12. The required information to be introduced on the card 14 is inserted on its surface 14.2 and, due to the construction of the business form 10, the full surface area of said surface 14.2 can be utilised for this information.

Prior to the laminating of the strip 20 to the surface 54 of the carrier 12, a crack cut 64 is made in the part 30.2 of the backing sheet 30. This crack cut 64 facilitates peeling away of the backing sheet 30 to expose the part 20.1 of the strip 20 in the window 18.

Thus, for use, after insertion of the information on the surface 14.2 of the card 14, the part 20.1 is folded about the centre perforation 60, as illustrated by arrow 66 after removal of the backing sheet 30. The part 20.1 of the strip 20 is adhered to the surface 14.2 of the card 14. The card 14 and those parts of the strip 20 covering the surfaces 14.1 and 14.2 of the card are removed from the carrier 12 and the remainder of the strip 20 by breaking the perforations 16,24.

Figure 6:
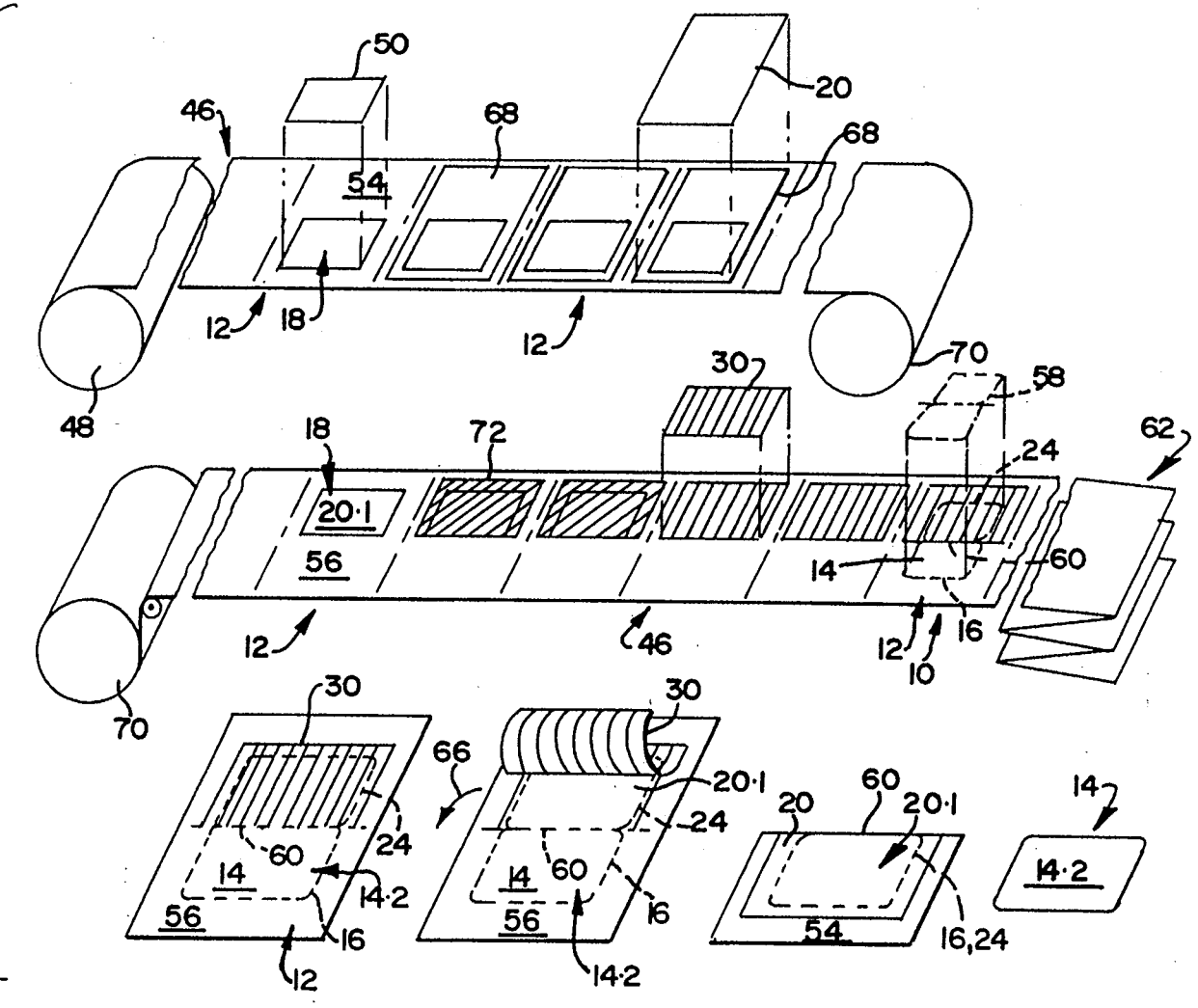
FIG. 6 shows various stages of another embodiment of the manufacture and use of the business form of FIGS. 1, 2 and 3*b*.

Referring now to FIG. 6 of the drawings, a further method of manufacturing the business form of FIGS. 1, 2 and **3*b* is illustrated. With reference to FIG. 5** of the drawings, like reference numerals refer to like parts, unless otherwise specified.

In this embodiment, after the window 18 has been cut using the cutting die 50, adhesive 68 is laid on the surface 54 of the carrier 12 about the window 18 and adjacent the window 18 in the position where the card 14 will be demarcated. The strip 20 is then secured to the surface 54 of the carrier 12 via the adhesive 68. The web 46 is thereafter rolled onto a roll 70.

In the next stage of the operation, the roll 70 is unrolled so as to expose the surface 56 of the carrier 12.

A coating of adhesive 72 is applied to the surface 56 of the carrier 12 about three sides of the window 18, excluding the side of the window 18 which will be common with the card 14, and on the part 20.1 of the strip 20 visible through the window 18. The backing sheet, in the form of a silicone release 30 and, as described above, shown by the solid line 33 in FIG. 1 of the drawings, is applied over the adhesive 72 whereafter, using the die cutter 58 the perforations 16, 24 and 60 are formed to demarcate the card 14 in the carrier 12.

The web 46 is then concertina folded, as illustrated at 62, and is ready for use.

For use, in a similar manner to that described above with reference to FIG. 5 of the drawings, after the information has been inserted on the surface 14.2 of the card, the silicone release 30 is removed and the carrier 12 is folded about the arrow 66 to adhere the part 20.1 of the strip 20 to the surface 14.2 of the card 14. Thereafter, the card 14 is removed from the carrier 12 and the remainder of the strip 20 by breaking the perforations 16, 24.

Figure 4:
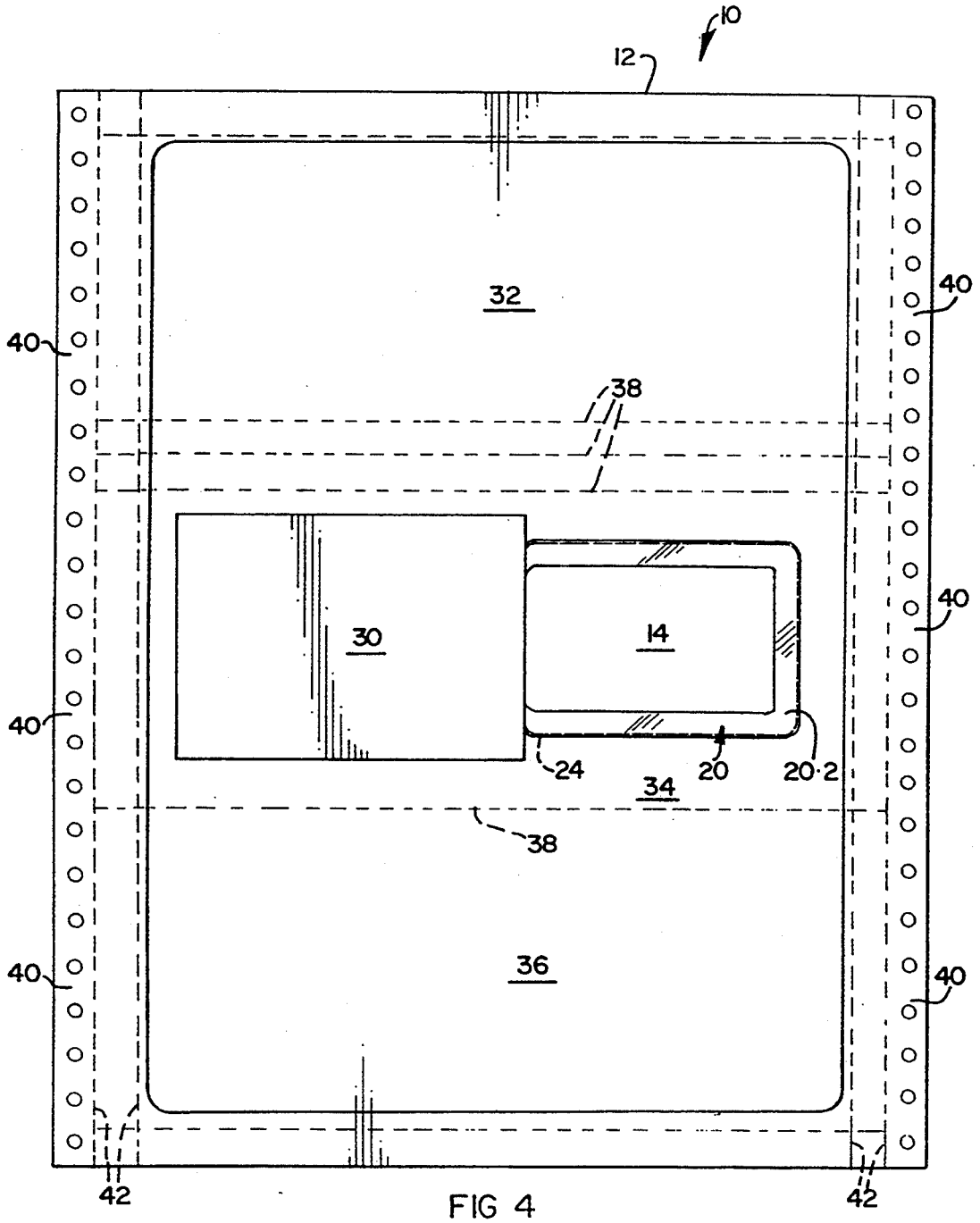
FIG. 4 shows a front view of a business form, in accordance with a second embodiment of the invention.

Referring now to FIG. 4 of the drawings, a form 10 in accordance with a second embodiment of the invention is illustrated. With reference to FIG. 1 to 3 of the drawings, like reference numerals refer to like parts, unless otherwise specified.

In this embodiment of the invention, the card 14 is a separate member. Thus, while the carrier 12 is of a first grade of paper, for example, 80 gsm, the card 14 is of a second, higher grade of paper, for example, 120 gsm.

In this case, in the manufacture of the form 10, a double window 18 is formed in the carrier 12. The strip 20 is attached to the carrier in register with the double window and the card 14 is selectively doubled to a part 20.2 of the strip 20.

In use, referring to both embodiments of the invention, predetermined information is printed on the carrier 12 including the card 14. The carrier 12 is then folded in a Z-like configuration and is sealed for mailing. To effect sealing of the form 10, predetermined zones of the carrier 12 carry adhesive thereon. Upon receipt of the form 10 by the recipient, the required information is applied to the surface 14.2 of card 14 and the card 14 is removed from the carrier as described above with reference to FIGS. 5 and 6 of the drawings.

It will be appreciated that both surfaces 14.1 and 14.2 of the card 14 are protected by the synthetic plastics material resulting in the card 14 having a longer life than would otherwise be the case. Also, the full area of the surface 14.2 of the card 14 can be used for information due to the fact that the adhesive coating is carried by the part 20.1 of the strip 20.

Further, it will be appreciated that in the case of the second embodiment of the invention, a substantially moisture-tight border is formed around the card 14 by the strip 20 when the part 20.1 is folded over and adhered to the surface 14.2 of the card 14 and that part 20.2 of the strip bordering the card 14. A similar arrangement can be effected in respect of the first embodiment of the invention by having a border strip of paper (not shown) demarcated about the periphery of the card 14, intermediate the card 14 and the carrier 12. Then, prior to folding over the part 20.1 of the strip 20 onto the surface 14.2 of the card 14, the border strip of paper is removed to expose that region of the part 20.2 of the strip 20 bordering the card 14. The border strip of paper can be formed by butt-cutting a peripheral line of perforations (not shown) about the card 14 in the carrier 12 parallel to the edge of the card 14. Prior to the laminating of the carrier 12 and the strip 20 together, adhesive would be selectively applied to that part of the surface 54 of the carrier 12 which will form the rear of the card 14 only. In other words, the part of the surface 54 of the carrier 12 which will form the border strip would be free of adhesive.

I claim:

1. A business form comprising:

a planar carrier including a card and a window defined in the carrier adjacent the card;

a planar element of a synthetic plastics material laminated to the carrier and extending over the card and the window so that a part of the element is arranged within the window with a zone of weakness extending through said element in registry with said card and window; and a coating of adhesive material carried by at least that part of the element in the window so that, upon removal of the card and that part of the element in the window by rupturing said zone of weakness, said part of the element can be folded over onto the card and adhesively secured to the card to form an arrangement where both surfaces of the card are covered by the plastics material.

2. The form as claimed in claim 1, in which the adhesive material is a pressure sensitive adhesive.

3. The form as claimed claim 1, in which the coating of adhesive on said part of the element in the window is covered by a removable backing sheet.

4. The form as claimed in claim 1, in which the carrier is in the form of a sheet of paper on which predetermined information is carried.

5. The form as claimed in claim 4, in which the card is a separate member which is secured on the element.

6. The form as claimed in claim 5, in which the card is of a different grade of paper from the paper of the carrier.

7. The form as claimed in claim 5, in which the carrier is substantially rectangular and is divided into three substantially equal parts, the parts being demarcated by fold lines.

8. The form as claimed in claim 7, in which the card and the window are arranged in a central part of the carrier with the element being laminated to said central part, the carrier being foldable about said fold lines in a predetermined configuration for mailing purposes.

9. The form as claimed in claim 5, in which a double window is defined in the carrier with the card being mounted on a part of the element in one of the windows, and at least that part of the element in the other of the windows has the coating of adhesive.

10. The form as claimed in claim 9, in which the card is smaller than the window in which it is arranged to be surrounded by a border region of synthetic plastics material defined by the planar element.

11. The form as claimed in claim 10, in which the border region defined by the element also carries a coating of adhesive material.

12. The form as claimed in claim 11, in which the adhesive material is a pressure sensitive adhesive.

13. The form as claimed in claim 12, in which the coating of adhesive material is covered by a removable backing sheet.

14. The form as claimed in claim 1 in which the card is demarcated in the carrier.

15. The form as claimed in claim 14, in which the carrier is substantially rectangular and is divided into three substantially equal parts, the parts being demarcated by fold lines.

16. The form as claimed in claim 15, in which the card and the window are arranged in a central part of the carrier with the element being laminated to said central part, the carrier being foldable about said fold lines in a predetermined configuration for mailing purposes.

17. The form as claimed in claim 14, in which the card is demarcated in the carrier by a zone of weakness circumscribing the card.

18. The form as claimed in claim 17, in which the card is substantially rectangular in outline and is bounded on at least three sides by said zone of weakness with the window being arranged adjacent a fourth side of the card such that the window and the card have a common side.

19. The form as claimed in claim 18, wherein the card and said part of the element within the window are substantially the same size.

20. The form as claimed in claim 17, in which the zone of weakness is in the form of perforations which extend through the carrier and the element.

21. The form as claimed in claim 20, in which said part of the element in the window of the carrier is separable from the remainder of the element via a further zone of weakness.

22. The form as claimed in claim 21 in which said further zone of weakness is also in the form of perforations.

23. A method of manufacturing a business form comprising the steps of:

providing a planar carrier;

forming a window in the carrier;

laminating a planar element of a synthetic plastics material to one surface of the carrier in register with the window and to a region adjacent the window so that a part of the element is arranged within the window and at least said part has a coating of adhesive material;

demarcating a card in the carrier in said region adjacent the window; and forming a zone of weakness in the element substantially in register with said card and window.

24. The method as claimed in claim 23, which includes providing the carrier in a continuous web, each carrier being demarcated in the web.

25. The method as claimed in claim 23, which includes demarcating the card adjacent the window by forming a zone of weakness, in the shape of the card, in the carrier adjacent the window.

26. The method as claimed in claim 25, which includes forming the zone of weakness by making perforations in the carrier and in that part of the element adjacent the window.

27. The method as claimed in claim 26, which includes forming a further zone of weakness in that part of the element in the window, said zone of weakness circumscribing an area of the element which is substantially the same area as that of the card.

28. The method as claimed in claim 23, which includes providing the planar element with one side thereof coated with an adhesive material, the adhesive material being covered by a backing sheet.

29. The method as claimed in claim 28, in which the window and the card are substantially rectangular in outline with the card being arranged against one side of the window to have a common side with the window and in which the method includes applying an adhesive about remaining sides of the window, other than the common side, on said one surface of the carrier.

30. The method as claimed in claim 29, which includes removing a part of the backing sheet from the element to expose the coating of adhesive material on a further part of the planar element, adjacent said part of the element which is in register with the window in the carrier, and laminating the planar element to said one surface of the carrier by adhesively securing said further part of the planar element to the carrier adjacent the window and, by means of the adhesive around said remaining sides of the window, attaching a remaining part of the backing sheet of the planar element to said one surface of the carrier.

31. The method as claimed in claim 30, which includes forming a cut in the backing sheet parallel to a direction of travel through a manufacturing machine to remove said part of the backing sheet and aligning said cut with the common side between the window and the card.

32. The method as claimed in claim 23, which includes, after the window has been formed in the carrier, and before the card is demarcated, applying an adhesive around the window and in the region adjacent the window on said one surface of the carrier and adhesively securing the planar element to said side of the carrier.

33. The method as claimed in claim 32, which includes, on an opposed surface of the carrier, applying a coating of adhesive at least on that part of the element in the window and covering the coating with a removable backing sheet.

34. A method of manufacturing a business form comprising the steps of:

providing a planar carrier;

forming a double window in the carrier;

laminating a planar element of a synthetic plastics material to the carrier in register with the double window;

mounting a card on the element in one of the windows; and forming a zone of weakness extending through said element in the window about the card.

35. The method as claimed in claim 34, which includes coating at least that part of the element in the other of the windows with an adhesive material.

36. The method as claimed in claim 35, which includes covering the coating with a removable backing sheet.

* * * * *